US007036565B2

(12) United States Patent
Brost et al.

(10) Patent No.: US 7,036,565 B2
(45) Date of Patent: May 2, 2006

(54) EXHAUST HEAT EXCHANGER

(75) Inventors: Viktor Brost, Aichtal (DE); Roland Strähle, Unerensingen (DE); Thomas Eckert, Neuweiler (DE)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 10/865,295

(22) Filed: Jun. 9, 2004

(65) Prior Publication Data

US 2005/0006060 A1 Jan. 13, 2005

(30) Foreign Application Priority Data

Jun. 26, 2003 (DE) ..... 103 28 638

(51) Int. Cl.
*F28F 27/02* (2006.01)

(52) U.S. Cl. ..... 165/103; 165/167

(58) Field of Classification Search ..... 165/103, 165/164, 166, 167, 916, 148, 145, 157
See application file for complete search history.

(56) References Cited

U.S. PATENT DOCUMENTS

| | | | | |
|---|---|---|---|---|
| 2,529,915 | A * | 11/1950 | Chausson | 165/122 |
| 4,595,051 | A * | 6/1986 | Cadars et al. | 165/122 |
| 6,141,961 | A * | 11/2000 | Rinckel | 60/288 |
| 6,213,105 | B1 * | 4/2001 | Banzhaf et al. | 123/568.12 |
| 6,250,380 | B1 * | 6/2001 | Strahle et al. | 165/167 |
| 6,302,191 | B1 * | 10/2001 | Wickham et al. | 165/103 |
| 6,330,910 | B1 * | 12/2001 | Bennett | 165/103 |
| 2002/0144803 | A1 * | 10/2002 | Worner | 165/103 |
| 2003/0111211 | A1 * | 6/2003 | Stonehouse et al. | 165/103 |
| 2004/0206342 | A1 * | 10/2004 | Moyer et al. | 165/157 |
| 2005/0133202 | A1 * | 6/2005 | Jorgensen et al. | 165/103 |

FOREIGN PATENT DOCUMENTS

| | | |
|---|---|---|
| DE | 195 40 683 | 5/1997 |
| DE | 197 33 964 | 2/1999 |
| DE | 199 06 401 | 8/2000 |
| DE | 199 62 863 | 6/2001 |
| DE | 101 42 539 | 3/2003 |
| DE | 102 29 083 | 2/2004 |
| EP | 0 987 427 | 3/2000 |
| EP | 0 942 156 | 11/2000 |
| EP | 0 916 837 | 4/2001 |
| EP | 0 992 756 | 6/2001 |

(Continued)

*Primary Examiner*—Teresa J. Walberg
(74) *Attorney, Agent, or Firm*—Wood, Phillips, Katz, Clark & Mortimer

(57) ABSTRACT

A housingless heat exchanger including a stack of flat tubes with at least two being cooling tubes and at least one being a bypass tube. Collecting tanks are on the tube ends and diffuse gas streaming in the tube flow paths. The flat tubes each comprise a connected pair of plates defining a flow path, and an enclosed space is defined between adjacent flat tubes. Coolant inlet and outlet channels are formed by connected plate openings connect to the enclosed space between the cooling tubes whereby coolant flows through that enclosed space. A switching valve in one collecting tank is movable between a cooling position in which the gas streams through the cooling tubes and a bypass position in which the gas streams through the bypass tube. A closure in the coolant inlet and outlet channels blocks coolant from adjacent the bypass tube. An insulating plate may also, or alternatively, be between the bypass tube and the cooling tube adjacent the bypass tube to block heat exchange between coolant and the bypass tube.

15 Claims, 4 Drawing Sheets

EXHAUST HEAT EXCHANGER

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward heat exchangers, and particularly toward exhaust heat exchangers usable in vehicles.

BACKGROUND OF THE INVENTION AND TECHNICAL PROBLEMS POSED BY THE PRIOR ART

Exhaust heat exchangers may be advantageously used, for example, to cool exhaust gas, allowing it to be recirculated for emission reduction in vehicles. The recirculated exhaust must be cooled in order to achieve high efficiency during recirculation, especially to achieve better degrees of filling. The entire system (i.e., the vehicle with its internal combustion engine) and an overall significantly reduced energy balance is naturally at issue.

For many years, however, all the operating situations in the vehicle have been analyzed and measures taken according to many different operating situations to be encountered. One such measure consists of bypassing the exhaust heat exchanger in operating situations in which cooling of the exhaust would be counterproductive. Such operating situations include the starting phases of the vehicle, which require considerable fuel and in which the heat energy of the exhaust, for example, may be used directly for rapid warm-up of the engine to its optimum operating temperature. Solutions like those described in European patent applications/patents EP 916 837 and EP 987 427, and ordinarily propose bypassing the exhaust heat exchanger. Specifically, a valve is arranged in front of the exhaust inlet to the exhaust heat exchanger, whereby the valve may feed the exhaust stream, as necessary, through the exhaust heat exchanger or past it directly into the recirculation line. The bypass is integrated in the valve.

Additional solutions have been described in German applications DE 197 33 964 A1 or DE 199 06 401 A1, which show the manner in which recirculation can occur. In the first named document, a bypass line and the exhaust heat exchanger are separated from each other, but both are apparently arranged in a common housing and the bypass line in the latter goes around the heat exchanger outside of it without both being enclosed by a housing. The exhaust heat exchangers themselves are apparently so-called tube bundle heat exchangers or coil tube heat exchangers. These exhaust heat exchangers do not appear to be particularly compact, which is of particular importance in the limited engine compartment space of motor vehicles.

Bypassing the heat exchangers is generally also required in exhaust heat exchangers per se. That is, even in heat exchangers proposed decades ago and (still) used in heaters for the passenger compartments of vehicles, among other things, bypassing is desired because the heat demand is not permanently present. However, those exhaust heat exchangers also usually belong to the tube bundle type or coil tube type. Exhaust heat exchangers, as explained in EP 942 156 A1, are included here.

Integrated bypasses have also been used heretofore, but in connection with heat exchanger designs which often must be manufactured by demanding welding methods, were described in DE 101 42 539 A1, in DE 199 62 863 A1 and in DE 195 40 683 A1.

The present invention is directed toward overcoming one or more of the problems set forth above.

SUMMARY OF THE INVENTION

The present invention relates to a heat exchanger having a housingless plate design in which flat tubes are formed by two deformed plates, the tubes being stacked with an inlet collecting tank being arranged at one end of the stack of flat tubes in the fashion of a diffusor, and an outlet collecting tank at the other end, for example, for exhaust or charge air which selectively flows through the flat tubes. Coolant for the air can be introduced into the tube stack and withdrawn from it through channels, the channels being formed by connected openings in the deformed plates.

In one aspect of the present invention, a housingless heat exchanger is provided, including a stack of flat tubes with at least two of the tubes being cooling tubes and at least one of the flat tubes being a bypass tube, and at least one collecting tank on one end of the stack of flat tubes for gas streaming in the tube flow paths. Each of the flat tubes comprise a pair of plates connected to define a flow path therethrough, and an enclosed space is defined between adjacent flat tubes. Coolant inlet and outlet channels are formed by connected openings in the plates, with the channels being hydraulically connected to the enclosed space between the cooling tubes whereby coolant flows through the enclosed space between the cooling tubes. A switching valve in the collecting tank is movable between a cooling position in which at least most of the gas streams through the cooling tubes and a bypass position in which at least most of the gas streams through the bypass tube. A closure in the coolant inlet and outlet channels blocks coolant from adjacent the bypass tube.

In one form of this aspect of the invention, the enclosed space between the bypass tube and the cooling tube adjacent the bypass tube includes at least a portion adjacent the bypass tube, and the closure blocks coolant from the enclosed space portion.

In another form of this aspect of the invention, the cooling and bypass tubes have substantially the same configuration. In a further form, the pairs of plates of the cooling and bypass tubes are substantially the same as each other.

In still another form of this aspect of the invention, the at least one bypass tube has a larger cross-section than at least one of the cooling tubes.

In yet another form, the plates of the pairs of plates are joined about their edges, and the plates include contoured sections defining the enclosed spaces.

In a still further form of this aspect of the invention, a insert is between the plates in the cooling tubes.

In another aspect of the invention, the closure includes an insulating plate between the bypass tube and the cooling tube adjacent the bypass tube.

In one form of this aspect, the insulating plate separates the enclosed space between the bypass tube and the cooling tube adjacent the bypass tube, whereby a coolant flow path is defined between the insulating plate and the cooling tube adjacent the bypass tube. In a further form, an untraversed enclosed space is defined between the insulating plate and the bypass tube, and the closure blocks coolant from the untraversed enclosed space. In a still further form, the untraversed space has heat-insulating properties.

In another form of this aspect, the insulating plate includes an end protruding beyond the stack of flat tubes, and the protruding end cooperates with the switching valve. In a further form, the switching valve includes a flap, and the flap cooperates with the insulating plate end to either close the cooling tubes in the bypass position or close the bypass tube in the cooling position.

In still another form of this aspect, the switching valve includes a flap having an axis substantially in the plane of the insulating plate.

In one aspect of the present invention, a housingless heat exchanger is provided, including a stack of flat tubes with at least two of the tubes being cooling tubes and at least one of the flat tubes being a bypass tube, and at least one collecting tank on one end of the stack of flat tubes for gas streaming in the tube flow paths. Each of the flat tubes comprise a pair of plates connected to define a flow path therethrough, and an enclosed space is defined between adjacent flat tubes. Coolant inlet and outlet channels are formed by connected openings in the plates, with the channels being hydraulically connected to the enclosed space between the cooling tubes whereby coolant flows through the enclosed space between the cooling tubes. A switching valve in the collecting tank is movable between a cooling position in which at least most of the gas streams through the cooling tubes and a bypass position in which at least most of the gas streams through the bypass tube. An insulating plate is between the bypass tube and the cooling tube adjacent the bypass tube, the insulating plate blocking heat exchange between coolant and the bypass tube.

BRIEF DESCRIPTION OF THE DRAWINGS

The invention is described herein via practical examples, with written descriptions and the following figures.

Figure 1:
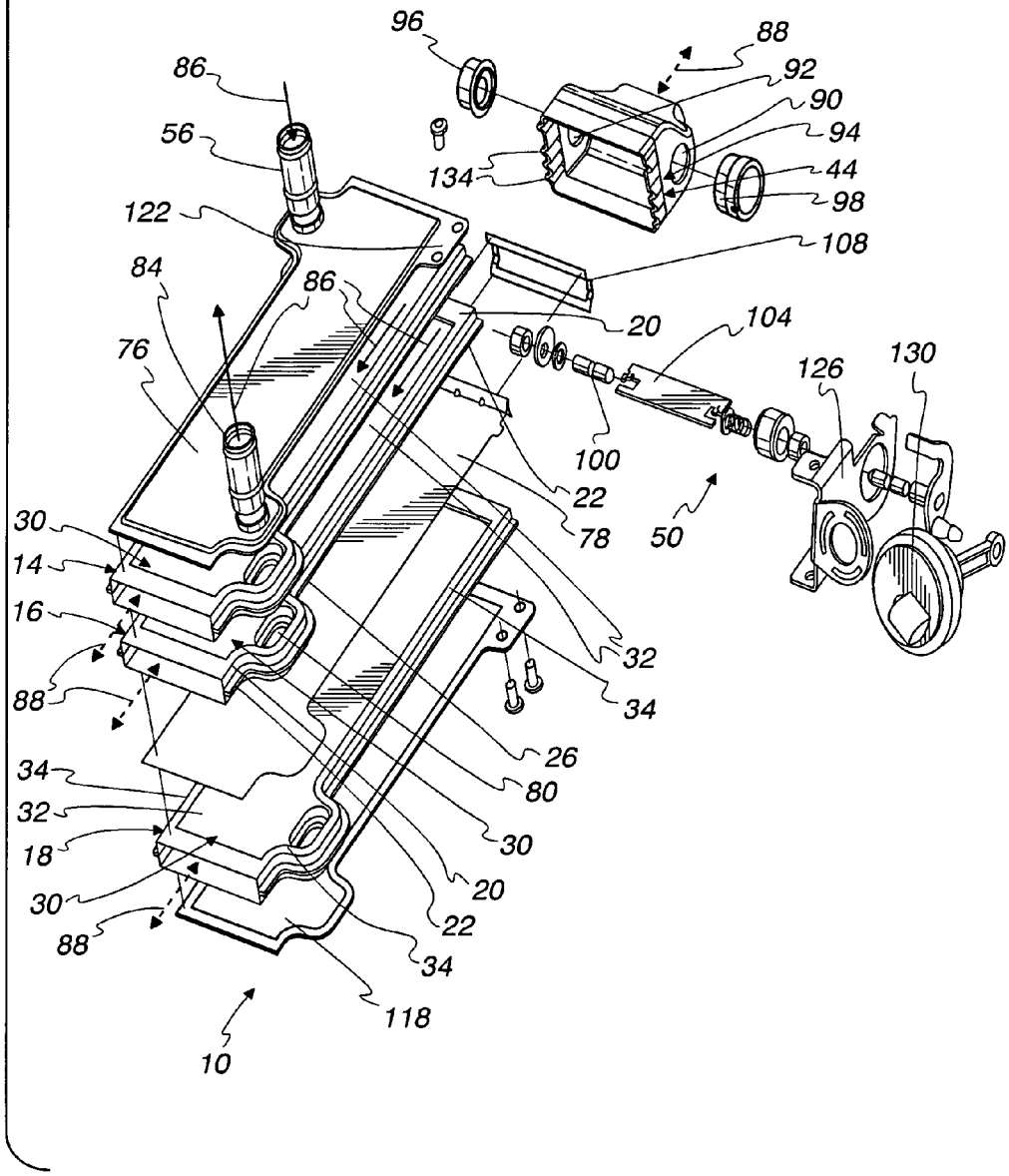
FIG. 1 is a perspective exploded view of one embodiment of a heat exchanger according to the present invention.
Figure 2:
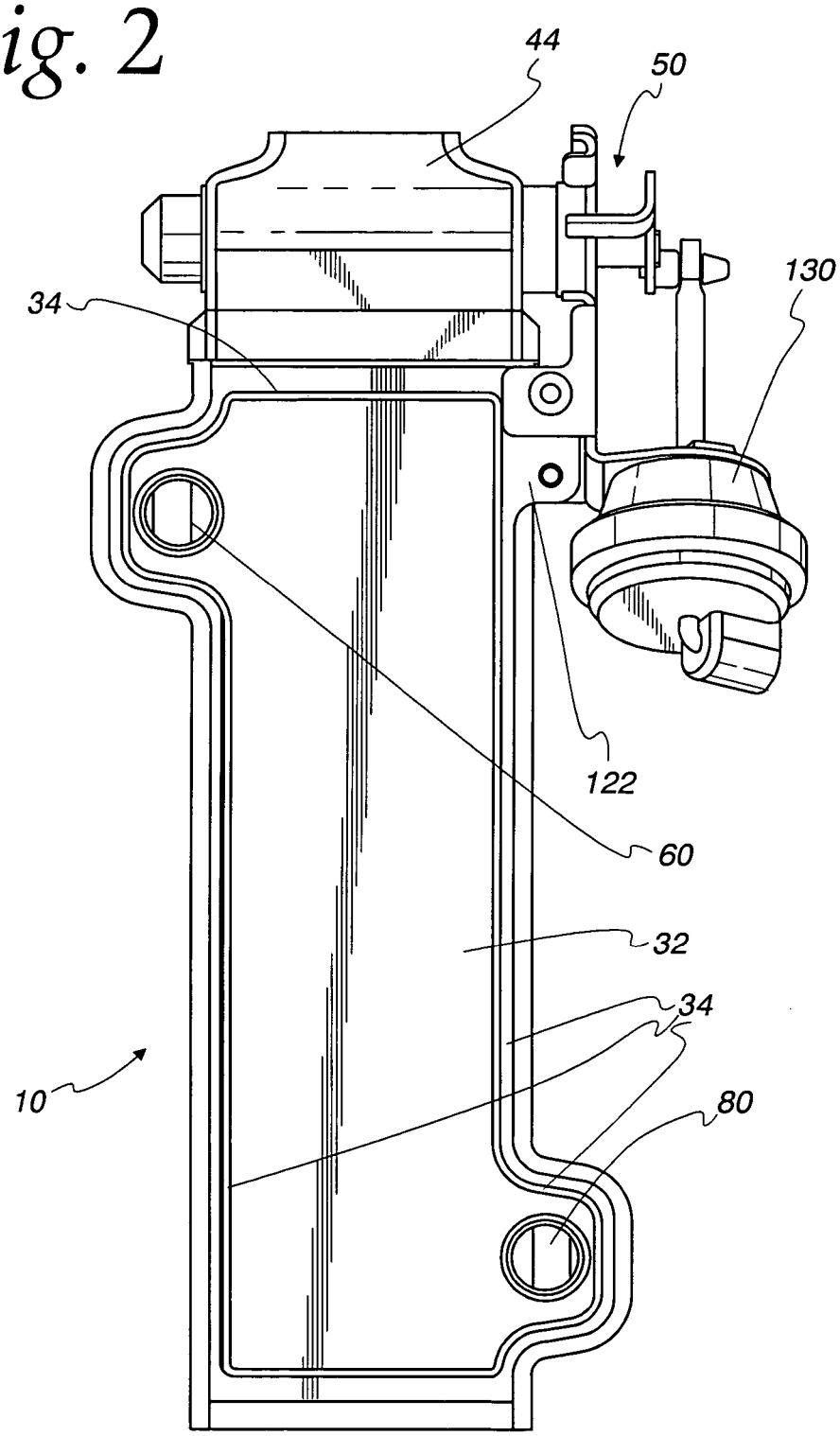
FIG. 2 is a top view of the heat exchanger of FIG. 1.

Additional features and advantages which prove to be particularly important are apparent from this description.

DETAILED DESCRIPTION OF THE INVENTION

A housingless exhaust heat exchanger 10 embodying to the present invention is variously shown in the Figures. In the illustrated exemplary embodiment, the heat exchanger 10 is for use with a vehicle cooled by the coolant (preferably liquid) of the internal combustion engine.

In the illustrated embodiment, the heat exchanger 10 includes three flat tubes 14, 16, 18, each of which is advantageously formed of a pair of deformed plates 20, 22 suitably joined along their generally longitudinal edges 26. The plates 20, 22 also have a peripheral contoured section 30 with a recessed face 32 surrounded by a peripheral lip 34, such as described in EP 992 756 B1, the disclosure of which is hereby fully incorporated by reference. EP Application 03 007 724.2 (EP Publication 1 376 043 A2) also discloses features of a housingless heat exchanger which may be used with the present invention, the disclosure of which is hereby also fully incorporated by reference.

The flat tubes 14, 16, 18 are stacked one on the other, with the contoured section 30 on the bottom (according to the FIG. 1 orientation) of the plate 22 of the top tube 14 abutting the contoured section 30 on the top of the plate 20 of the middle tube 16, and the contoured section 30 on the bottom (according to the FIG. 1 orientation) of the plate 22 of the middle tube 16 abutting the contoured section 30 on the top of the plate 20 of the bottom tube 18. Flow channels are defined between selected contoured sections as further described below.

Figure 3:
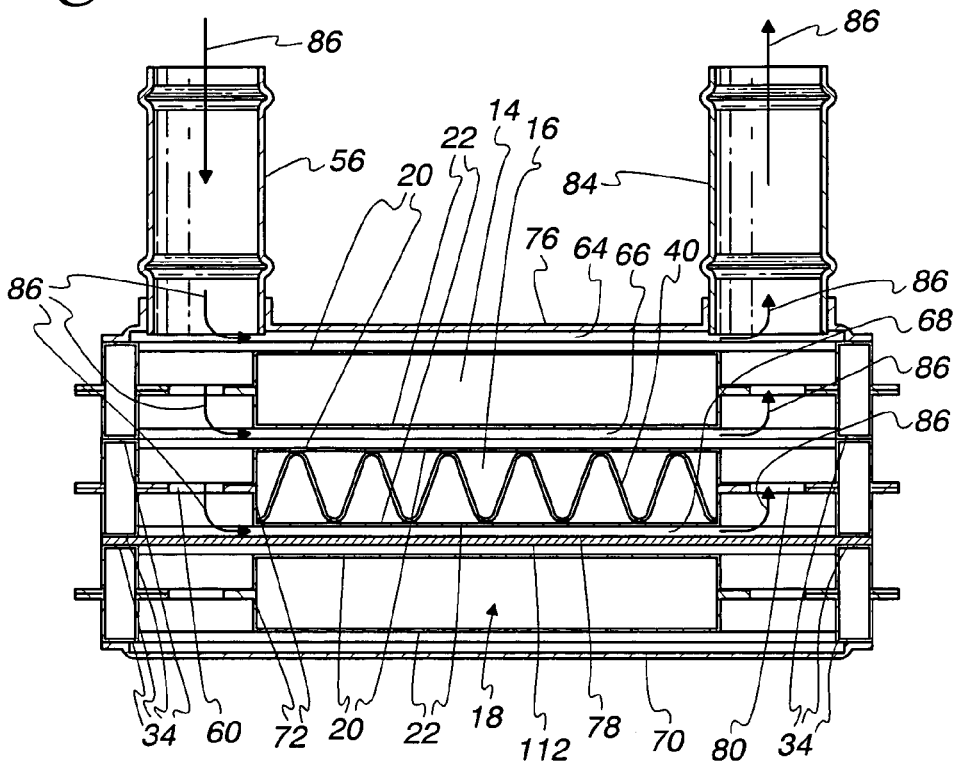
FIG. 3 is a transverse cross-section through the heat exchanger of FIG. 1.

Only three flat tubes 14, 16, 18 are shown in the practical example. It should be understood, however, that other numbers of such tubes could be used in heat exchangers incorporating the present invention, with the number of flat tubes 14, 16, 18 chosen, for example, according to the performance requirements of the heat exchanger 10. As will be apparent from the further description below, two of the flat tubes 14, 16 are cooled and one of the flat tubes 18 is not cooled. It is expedient to provide the cooled or cooling flat tubes 14, 16 with a suitable internal insert 40 such as is known in the art (e.g., a serpentine fin) as indicated in FIG. 3.

At one end of the stack of flat tubes 14, 16, 18, a collecting tank 44 is arranged in the fashion of a diffusor, and another collecting tank 46 (see FIG. 6) is provided on the other end of the tube stack. The two collecting tanks 44, 46 may be identical, apart from the differences caused by the switching valve 50, which are explained further below. The exhaust (or charge air, depending upon the system with which the heat exchanger 10 is used) will thus selectively flow (based on the switching valve 50) through flow paths in the flat tubes 14, 16, 18 as described below. EP Application 03 007 724.2 (EP Publication 1 376 043 A2) also discloses diffuser features which may be used with the present invention. The disclosure of the EP Application has already been fully incorporated by reference herein.

Coolant, which may be selectively used to cool the exhaust as described below, may be directed through an inlet connector 56 to inlet channels 60 defined by openings in side flanges of the plates 20, 22. The inlet channels 60 are aligned as further described below, whereby coolant from the inlet connector 56 may pass through the inlet channels 60 and, from there, to flow channels 64, 66, 68 defined at the contoured sections 30 of the plates 20, 22.

Housingless heat exchangers of this general type have been shown, for example, in German application DE 102 29 083.0, European application EP 03 007 724.2 (EP Publication 1 376 043 A2), and EP 992 756 B1, the disclosures of which are all hereby fully incorporated by reference. Such heat exchangers are very compact and have very good functional properties.

In the heat exchanger 10 of the present invention, perforations 72 that can be produced by metalworking are arranged around each inlet channel defining opening to connect the openings in the practical example. Inlet channels 60, which pass through the heat exchanger 10 vertically (in the orientation shown in FIG. 1, with the tubes 14, 16, 18 horizontally oriented), may be suitably obtained by joining the perforations 72 (see FIGS. 3 and 4).

In the illustrated embodiment, one flow channel 64 is defined between the contoured section 30 of the top plate 20 of the top tube 14 and a cover plate 76 secured thereon. A second flow channel 66 is defined between the contoured sections 30 of the bottom plate 22 of the top tube 14 and the top plate 20 of the middle tube 16. A third flow channel 68 is defined (in the FIG. 3 embodiment) between the contoured section 30 of the bottom plate 22 of the middle tube 16 and an insulating plate 78 (described further below).

The flow channels 64, 66, 68 outlet to outlet channels 80 which may be formed similarly to the inlet channels 60, such channels 80 being aligned whereby coolant from each of the flow channels 64, 66, 68 may be discharged through an outlet connector 84.

It should thus be appreciated that coolant may advantageously flow (in the direction of solid arrows 86) through the flow channels 64, 66, 68 to cool exhaust passing (in the direction of dashed arrows 88) through the top and middle flat tubes 14, 16. As indicated by the dashed arrows 88, flow of the exhaust through the tubes 14, 16, 18 could be in either direction depending on design choices.

The previously mentioned switching valve 50 may be advantageously installed, after soldering of the plates (e.g., 20, 22, 76, 78) of the exhaust heat exchanger 10, in two opposite openings 90, 92 in the wall 94 of collecting tank 44. Bearing bushes 96, 98 for a rotatable shaft 100 are inserted and fastened in these openings 90, 92, as shown in FIG. 1. A flap 104 is suitably secured to the rotatable shaft 100, and a flap cooperating element 108 is also inserted into the collecting tank 44 in order to support the effect of flap 104. That is, as is apparent from FIG. 5, the element 108 will define an opening whereby the flap 104 may be selectively moved between a bypass position blocking the top and middle tubes 14, 16 (on the right in FIG. 5) and a cooling position blocking the bottom tube 18 (on the left in FIG. 5). Thus, the switching valve 50 may be advantageously used to selectively direct exhaust air (or at least most of the recirculating exhaust stream) through selected ones of the various tubes 14, 16, 18, some of which are cooled and at least one of which (tube 18) is not cooled.

Figure 4:
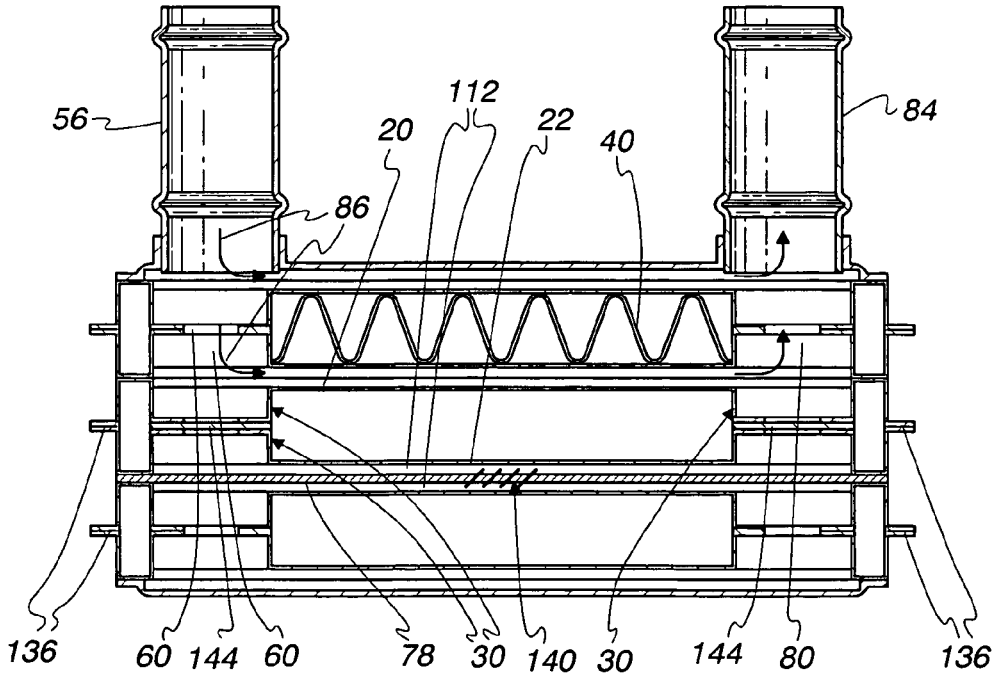
FIG. 4 is a transverse cross-section similar to FIG. 1 but showing an alternate embodiment.

The previously referenced insulating plate 78 is arranged between the cooled tubes 14, 16 and the at least one uncooled (bypass) flat tube 18. The insulating plate 78 may be essentially flat and is connected on one side to a deformed plate 20 of the at least one uncooled flat tube 18 and on the other side to a deformed plate 22 of the adjacent cooled (middle) tube 16. The insulating plate 78 is secured to the contoured section 30 of the two plates (plate 20 of tube 18 and plate 22 of tube 16). An untraversed space 112 having heat insulating properties is therefore left within the space between the insulating plate 78 and the deformed plates 20, 22 enclosed by the periphery of the contoured section 30 (FIG. 3). The periphery of the contoured section 30 may be advantageously roughly U-shaped in cross-section, as is best shown in FIGS. 3 and 4.

In addition to the cover plate 76, the heat exchanger 10 may also advantageously have a base plate 118, both also contoured and having a somewhat greater sheet thickness than the deformed heat exchanger plates 20, 22 in order to ensure additional stability. The base plate 118 and the cover plate 76 also include protrusions 122 for mounting a retainer bracket 126 for the switching valve 50 and control element 130.

Figure 5:
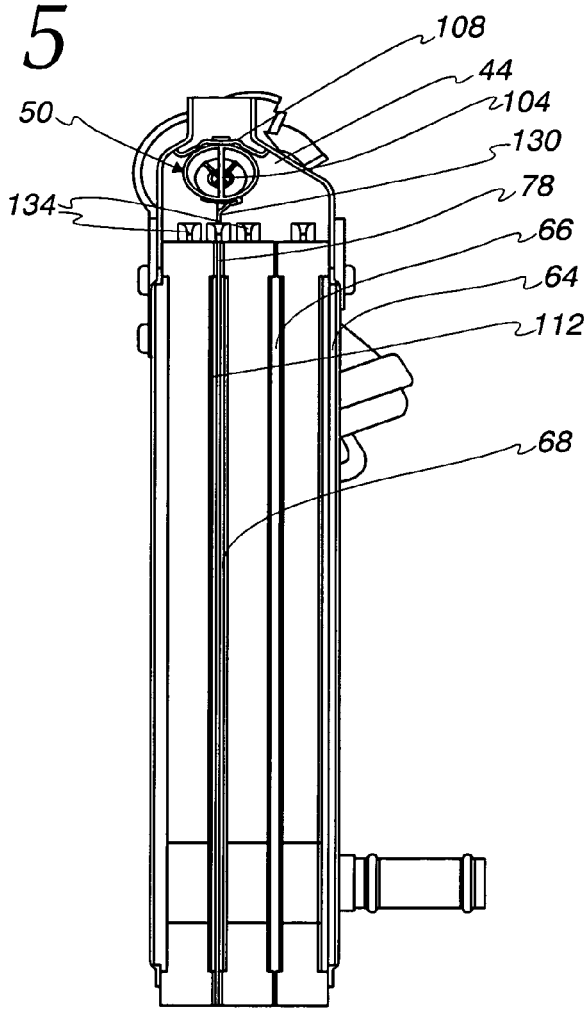
FIG. 5 is a longitudinal cross-section through a heat exchanger having an insulating plate according to one embodiment of the present invention.

As is apparent from the FIG. 5 embodiment in which the insulating plate 78 separates the cooled (14,16) and uncooled (18) flat tubes, the end 130 of the insulating plate 78 may advantageously extend beyond the tube plates 20, 22 so as to cooperate with the switching valve flap 104. The allows the flap 104 to be reduced in size, thereby minimizing the flap noises caused by flow of the exhaust and other functional disadvantages which can occur from a larger flap. The flap 104 can be reduced in size due to cooperation with the insulating plate end 130 and the flap cooperating element 108, as is apparent from FIG. 5.

The collecting tank 44 arranged in the fashion of a diffuser as previously noted, may advantageously have contoured sections 134 in its wall 94 (FIG. 1) that are intended to accommodate two edges 136 each (FIG. 4) on the end of the deformed plates 20, 22 of the flat tubes 14, 16, 18. Because of this, the entire stack of flat tubes 14, 16, 18 is held together and soldering is made possible in a single operation without additional aids. Further details concerning this are described in EP application No. 03 007 724.2 (EP Publication 1 376 043 A2), the entire disclosure of which is hereby incorporated by reference.

FIG. 3 is a cross-section through an exhaust heat exchanger of the type depicted in FIG. 1 passing through both the inlet channel 60 and outlet channels 80 for coolant.

FIG. 4 illustrates two different embodiments of the present invention. Specifically, as illustrated in the FIG. 3 embodiment, the inlet and outlet channels 60, 80 may extend to both sides of the middle tube 16 whereby coolant may flow on both sides of the middle tube 16, with the insulating plate 78 blocking the coolant from the contour section 30 of the bottom tube 18 and also itself serving as insulation to prevent cooling of exhaust air in the bottom tube 18 by the coolant. As schematically represented by reference numeral 140, the insulating plate 78 may be omitted where closures 144 block the channels 60, 80, as this blocks the coolant from reaching the space between the bottom and middle tubes 18, 16. Suitable closures 144 include, for example, a member inserted into the corresponding perforation 72 surrounding the opening defining the channels 60, 80, or by not punching out the openings in one or more of the deformed plates 20, 22 of the middle tube 16. Thus, it should be appreciated that the insulating plate 78 may therefore be dispensed with (but need not be) in the variant depicted in FIG. 4, although it is drawn in FIG. 4. The untraversed space 112 is larger in this embodiment than in the FIG. 3 embodiment previously described.

Figure 6:
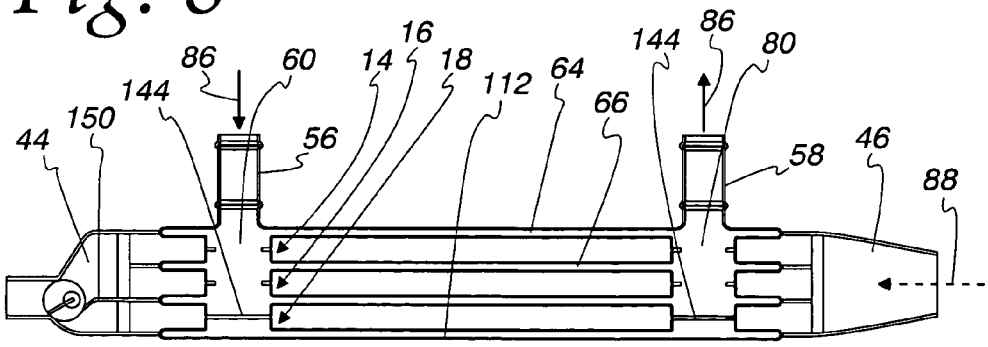
FIG. 6 is a longitudinal cross-section through a heat exchanger without insulation plate according to another embodiment of the present invention.

FIG. 6 is a longitudinal section through a heat exchanger according to FIG. 4 (i.e., having closures 144 separating the cooled [14, 16] and uncooled [18] flat tubes). With no insulating plate 76 provided in this embodiment, a separate partition 150 may be provided to serve the previously described function of the insulating plate end 130.

Only practical examples in which the cooled and uncooled flat tubes 14, 16, 18 all consist of the same substantially the same deformed plates 20, 22 have been depicted herein. Such a construction has significant manufacturing advantages. However, it should be understood that it can be expedient to make the cooled flat tubes 14, 16 from plates different from those of the uncooled flat tube 18, and that such structures would be within the scope of at least some facets of the present invention. Further, it should be understood that more flat tubes than illustrated, both for cooling and bypassing cooling, may also be provided within the scope of the present invention. Accordingly, it should further be appreciated that the present invention will provide advantageous design flexibilities.

The present invention provides a heat exchanger which may be advantageously used, for example, for selected cooling of exhaust in a vehicle. Moreover, such heat exchangers may benefit from the advantages of housingless heat exchangers while at the same time providing such desirable selected operation, in a compact structure which may be easily manufactured at relatively low cost. For example, the entire heat exchanger 10 can be connected or produced in a single soldering operation, notwithstanding integrated switching valve 50. The individual parts of the exhaust heat exchanger 10 may be easily combined by pushing the collecting tanks 44, 46 pushed over the ends of the flat tubes 14, 16, 18. Demanding welding operations, as are necessary in heat exchangers from the prior art, may thus be avoided.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A housingless heat exchanger, comprising:

a stack of flat tubes with at least two of said tubes being cooling tubes and at least one of said flat tubes being a bypass tube, wherein each of said flat tubes comprise a pair of plates connected to define a flow path therethrough, and an enclosed space is defined by facing ones of said plates between adjacent flat tubes;

at least one collecting tank on one end of the stack of flat tubes for gas streaming in said tube flow paths;

coolant inlet and outlet channels formed by connected openings in the plates, said channels being hydraulically connected to said enclosed space between the cooling tubes whereby coolant flows through said enclosed space between said cooling tubes;

a switching valve in the collecting tank movable between a cooling position in which at least most of the gas streams through the cooling tubes and a bypass position in which at least most of the gas streams through the bypass tube; and a closure in said coolant inlet and outlet channels blocking coolant from adjacent the bypass tube.

2. The heat exchanger of claim 1, wherein the enclosed space between said bypass tube and the cooling tube adjacent said bypass tube includes at least a portion adjacent said bypass tube, and said closure blocks coolant from said enclosed space portion.

3. The heat exchanger of claim 1, wherein the cooling and bypass tubes have substantially the same configuration.

4. The heat exchanger of claim 3, wherein said pairs of plates of said cooling and bypass tubes are substantially the same as each other.

5. The heat exchanger of claim 1, wherein said at least one bypass tube has a larger cross-section than at least one of the cooling tubes.

6. The heat exchanger of claim 1, wherein the plates of said pairs of plates are joined about their edges, and said plates include contoured sections defining said enclosed spaces.

7. The heat exchanger of claim 1, further comprising a insert between the plates in the cooling tubes.

8. The heat exchanger of claim 1, wherein said closure includes an insulating plate between said bypass tube and said cooling tube adjacent said bypass tube.

9. The heat exchanger of claim 8, wherein said insulating plate separates said enclosed space between said bypass tube and said cooling tube adjacent said bypass tube, whereby a coolant flow path is defined between said insulating plate and said cooling tube adjacent said bypass tube.

10. The heat exchanger of claim 9, wherein an untraversed enclosed space is defined between said insulating plate and said bypass tube, and said closure blocks coolant from said untraversed enclosed space.

11. The heat exchanger of claim 10, wherein the untraversed space has heat-insulating properties.

12. The heat exchanger of claim 8, wherein said insulating plate includes an end protruding beyond said stack of flat tubes, and said protruding end cooperates with the switching valve.

13. The heat exchanger of claim 12, wherein said switching valve includes a flap, and said flap cooperates with said insulating plate end to either close the cooling tubes in said bypass position or close said bypass tube in said cooling position.

14. The heat exchanger of claim 8, wherein the switching valve includes a flap having an axis substantially in the plane of the insulating plate.

15. A housingless heat exchanger, comprising:

a stack of flat tubes with at least two of said tubes being cooling tubes and at least one of said flat tubes being a bypass tube, wherein each of said flat tubes being substantially identical and comprising a pair of plates connected to define a flow path therethrough, and an enclosed space is defined by facing ones of said plates between adjacent flat tubes;

at least one collecting tank on one end of the stack of flat tubes for gas streaming in said tube flow paths;

coolant inlet and outlet channels formed by connected openings in the plates, said channels being hydraulically connected to said enclosed space between the cooling tubes whereby coolant flows through said enclosed space between said cooling tubes;

a switching valve in the collecting tank movable between a cooling position in which at least most of the gas streams through the cooling tubes and a bypass position in which at least most of the gas streams through the bypass tube; and an insulating plate between said bypass tube and said cooling tube adjacent said bypass tube, said insulating plate blocking heat exchange between coolant and said bypass tube.

* * * * *

UNITED STATES PATENT AND TRADEMARK OFFICE

CERTIFICATE OF CORRECTION

PATENT NO. : 7,036,565 B2
APPLICATION NO. : 10/865295
DATED : May 2, 2006
INVENTOR(S) : Viktor Brost et al.

It is certified that error appears in the above-identified patent and that said Letters Patent is hereby corrected as shown below:

Title page, item (75) Inventors: should read as follows:
Viktor Brost, Aichtal (DE); Roland Strähle, Unterensingen (DE); Thomas Eckert, Neuweiler (DE)

Signed and Sealed this

Tenth Day of April, 2007

JON W. DUDAS
*Director of the United States Patent and Trademark Office*